US012059108B2

(12) United States Patent
Knöpfle et al.

(10) Patent No.: US 12,059,108 B2
(45) Date of Patent: Aug. 13, 2024

(54) CLEANING DEVICE

(71) Applicant: VERMOP Salmon GmbH, Gilching (DE)

(72) Inventors: Matthias Knöpfle, Munich (DE); Frank Rücker, Gauting (DE)

(73) Assignee: VERMOP Salmon GmbH, Gilching (DE)

( * ) Notice: Subject to any disclaimer, the term of this patent is extended or adjusted under 35 U.S.C. 154(b) by 0 days.

(21) Appl. No.: 17/494,032

(22) Filed: Oct. 5, 2021

(65) Prior Publication Data

US 2022/0125269 A1 Apr. 28, 2022

(30) Foreign Application Priority Data

Oct. 6, 2020 (EP) ..... 20200247

(51) Int. Cl.
*A47L 11/30* (2006.01)
*A47L 11/40* (2006.01)

(52) U.S. Cl.
CPC ..... *A47L 11/302* (2013.01); *A47L 11/4005* (2013.01); *A47L 11/4041* (2013.01); *A47L 11/4058* (2013.01); *A47L 11/4075* (2013.01); *A47L 11/4083* (2013.01); *A47L 11/4088* (2013.01)

(58) Field of Classification Search
CPC ..... A47L 11/302; A47L 11/4005; A47L 11/4041; A47L 11/4058; A47L 11/4075; A47L 11/4083; A47L 11/4088; A47L 11/282; A47L 11/292; A47L 11/4044; A47L 11/4055
USPC ..... 15/322
See application file for complete search history.

(56) References Cited

U.S. PATENT DOCUMENTS

| | | | | |
|---|---|---|---|---|
| 5,319,828 | A | 7/1994 | Waldhauser et al. | |
| 5,347,678 | A | 9/1994 | Willians et al. | |
| 9,826,874 | B2 * | 11/2017 | Franke | A47L 11/4072 |
| 2005/0091782 | A1 | 5/2005 | Gordon et al. | |
| 2020/0359870 | A1 * | 11/2020 | Vernazza | A47L 11/4052 |

FOREIGN PATENT DOCUMENTS

| | | | | |
|---|---|---|---|---|
| DE | 19655370 | B4 * | 2/2009 | A46B 13/00 |
| WO | WO 01/54555 | A1 | 8/2001 | |
| WO | WO 2019/048496 | A1 | 3/2019 | |

OTHER PUBLICATIONS

DE-19655370-B4 translation (Year: 2009).*

* cited by examiner

*Primary Examiner* — Abbie E Quann
(74) *Attorney, Agent, or Firm* — Wolf, Greenfield & Sacks, P.C.

(57) ABSTRACT

A cleaning device includes a handle and a cleaning head which is movable on a surface to be cleaned. The cleaning head has at least one rotatable cleaning roller and a first lip element arranged adjacent to a first suction gutter which can be subjected to negative pressure by a suction pump, and the cleaning head has a second lip element arranged adjacent to a second suction gutter which can be subjected to negative pressure by the suction pump. The first and second lip elements may each be movable, and the handle may be pivoted to move the lip elements.

19 Claims, 8 Drawing Sheets

CLEANING DEVICE

Cross-Reference to Related Applications

This application claims priority to European Application No. 20 200 247.3, titled "CLEANING DEVICE," filed Oct. 6, 2020, now European Publication No. 3 981 312 A1, issued Apr. 13, 2022, which is herein incorporated by reference in its entirety.

FIELD OF THE INVENTION

The invention relates to a cleaning device comprising a handle, a cleaning head and at least one rotatable cleaning roller as well as a suction gutter which can be subjected to negative pressure by means of a suction pump and through which fluid can be suctioned off.

BACKGROUND OF THE INVENTION

Cleaning devices which act as automatic scrubber/suction apparatuses are known in the art. Such cleaning devices have a suction lip which wipes the cleaning fluid off the surface to be cleaned after wetting and mechanical processing, so that the cleaning fluid can be suctioned off. The cleaning process requires that the sequence of the individual cleaning steps is observed. In the direction of travel of the cleaning device, at first cleaning fluid must be supplied, then the surface to be cleaned must be cleaned mechanically, for example by means of brushes, and after that the cleaning fluid with the dirt therein must be suctioned off. This process-related sequence of cleaning steps results in that conventional cleaning devices configured as automatic scrubber/suction apparatuses can only be operated in a single direction of movement.

In particular in a spatially restricted environment, the operation of such a cleaning device in only a single direction of movement is often difficult and requires a high handling effort. In specific spatial situations, the handling effort increases to such an extent that the use of such an automatic scrubber/suction apparatus is no longer reasonably possible.

DESCRIPTION OF THE INVENTION

The invention is based on the object of suggesting a cleaning device which no longer requires unidirectional operation.

This object is solved by a cleaning device comprising the features of claim 1. Preferred embodiments are apparent from the remaining claims.

The cleaning device according to the invention comprises a handle and a cleaning head which is movable on a surface to be cleaned. The cleaning head comprises at least one rotatable cleaning roller and a first lip element arranged adjacent to a first suction gutter which can be subjected to negative pressure by means of a suction pump. The cleaning head further comprises a second lip element arranged adjacent to a second suction gutter which can be subjected to negative pressure by means of the suction pump. The first lip element and the second lip element are each movable between a raised position and a lowered position. The handle of the cleaning device is pivotable such that in a first position of the handle relative to the cleaning head, the first lip element is in the lowered position and the second lip element is in the raised position, and in the second position of the handle relative to the cleaning head, the first lip element is in the raised position and the second lip element is in the lowered position.

The cleaning device according to the invention can thus be operated such that, by pivoting the handle, one lip element is specifically lowered, while the other lip element is in a raised position. In this way, the cleaning device according to the invention can be configured such that in each case the lip element arranged at the rear in the direction of movement is in the lowered position, whereby after the mechanical cleaning process using cleaning fluid, the cleaning fluid can be wiped off the surface to be cleaned. In this way, at the end of the cleaning process, the cleaning fluid can be suctioned off in each case at the rear of the cleaning device in the direction of travel.

According to a preferred embodiment, the cleaning device comprises a first lever element which is pivotably mounted relative to the cleaning head and which is suited to move the first lip element from the lowered position into the raised position, and a second lever element which is pivotably mounted relative to the cleaning head and which is suited to move the second lip element from the lowered position into the raised position.

The use of levers which each raise the lip elements represents a simple technical solution. The lip elements can be spring-loaded into the lowered position, which requires only low spring force since the spring force must only support gravity.

According to a preferred embodiment, the handle is fixed to the cleaning head by means of an articulated lever, and in the first position of the handle, the articulated lever is in engagement with the second lever element, and in the second position of the handle, the articulated lever is in engagement with the first lever element.

In other words: In the first position of the handle relative to the cleaning head, the first lip element remains in the lowered position since in the first position, the articulated lever of the handle is in engagement only with the second lever element which raises the second lip element. In the second position of the handle relative to the cleaning head, the situation is reversed. The articulated lever is in engagement with the first lever element, which results in the first lip element being in the raised position, while the second lip element is in the lowered position since the articulated lever does not actuate the second lever element. In this way, it is possible to switch back and forth between the two operating states only by changing the position of the handle relative to the cleaning head. In this respect, the first position and the second position of the handle are to be defined such that, without any further intervention by a user but only by normal actuation of the handle when the cleaning device is moved back and forth, in each case the lip element arranged at the rear in the direction of travel is automatically lowered and the lip element arranged at the front in the direction of travel is automatically raised.

According to a preferred embodiment of the invention, the first suction gutter is connected to a first suction channel, and the second suction gutter is connected to a second suction channel. The first suction channel and the second suction channel open into a switching device which is connected to the suction pump. The switching device comprises an actuating member configured to close the flow connection to the first suction channel or the second suction channel.

The provision of such a switching device has the advantage that the negative pressure can be specifically guided to the first suction channel or the second suction channel.

During operation of the cleaning device, the fluid collected by the lip element which is in the lowered position must be suctioned off in each case. It does not make sense to apply negative pressure to the respective other suction channel adjacent to the lip element which is in the raised position since energy is used unnecessarily. The provision of a switching device comprising an actuating member configured to specifically close the flow connection to either the first suction channel or the second suction channel thus represents a reasonable supplement to the possibility of using the cleaning device in both directions of travel, which is realized according to the invention.

In the first position of the handle, the actuating member preferably closes the flow connection to the second suction channel, and in the second position of the handle, the actuating member closes the flow connection to the first suction channel. In this way, fluid is suctioned off in each case only where the lip element is in the lowered position.

According to a preferred embodiment of the invention, the first lip element together with the first suction gutter forms a unit, and the second lip element together with the second suction gutter forms a second unit. In this way, the lip elements, each together with the corresponding suction gutter, are moved between the lowered position and the raised position. In this way, the suction gutters can be configured such that they extend just to the surface to be cleaned, as a result of which the cleaning fluid can already be suctioned off at a lower negative pressure. In addition, the configuration as a unit has the advantage that the lip element can restrict the suction gutter on the one side.

The handle is preferably in operative connection with the actuating member of the switching device, and is movable by pivoting the handle between the first position and the second position. In this way, switching of negative pressure between the two suction gutters also takes place automatically and without any intervention by the user. The user thus operates the cleaning device in both directions of movement only via the handle which is pivotable relative to the cleaning head, with the operation being different depending on the position of the handle relative to the cleaning head. Automatically with the selection of the position of the handle, the lip element arranged at the rear in the direction of movement is brought into the lowered position, the lip element arranged at the front in the direction of movement is brought into the raised position, and only the suction gutter arranged at the rear in the direction of movement is subjected to negative pressure.

The operative connection between the handle and the actuating member of the switching device preferably comprises an articulated lever which translates pivoting of the handle into a rotational movement of the actuating member. This operative connection represents a simple and maintenance-free possibility of coupling pivoting of the actuating member to pivoting of the handle relative to the cleaning head.

According to a preferred embodiment of the invention, the cleaning device comprises two cleaning rollers arranged parallel to each other between the first suction channel and the second suction channel. During operation, both cleaning rollers can be driven, or only one of the two cleaning rollers. It makes sense if the user can select whether he wants to operate only one or both cleaning rollers. If there is a lot of dirt, it makes sense to use both cleaning rollers, which however means an increased energy consumption. It is also possible to actuate only one of the cleaning rollers automatically, for example the cleaning roller arranged at the rear in the direction of travel. In this respect, the first lever element and the second lever element can actuate an electrical contact which transfers the driving energy, depending on the position of the first lever element and of the second lever element, only to the drive unit for the corresponding cleaning roller.

The cleaning rollers preferably comprise cleaning brushes which have proven to be suitable for an intensive mechanical removal of dirt on the surface to be cleaned.

The device preferably comprises a storage container for cleaning fluid and nozzles for discharging the cleaning fluid in the direction of the surface to be cleaned and/or in the direction of the at least one cleaning roller. This measure also serves to automate the cleaning process as far as possible. During operation of the device, cleaning fluid is automatically discharged by means of nozzles, with wetting of the cleaning rollers having proven to be a very efficient method of effectively cleaning the surface to be cleaned.

According to a preferred embodiment, the device further comprises an energy storage for wirelessly operating the cleaning device, wherein the suction pump can be driven via an electric motor by means of energy in the energy storage for driving the at least one cleaning roller. The wireless operation of the cleaning device has advantages with regard to the efficient cleaning of larger surfaces, for example in the form of a large number of individual rooms, without the cleaning device having to be unplugged between rooms and plugged in again into a different socket in each case. The use of an energy storage for wirelessly operating the cleaning device is particularly suitable in connection with the switching device, by means of which only the suction gutter arranged at the rear in the direction of travel is subjected to negative pressure. In this way, a suction pump with lower power consumption can be used and the service life of the energy storage can be prolonged, whereby the weight of the energy storage and of the suction pump can be reduced.

BRIEF DESCRIPTION OF THE DRAWINGS

Hereinafter, the invention will be described, purely by way of example, by means of a specific embodiment. The figures show the following.

WAYS OF IMPLEMENTING THE INVENTION

Figure 1:
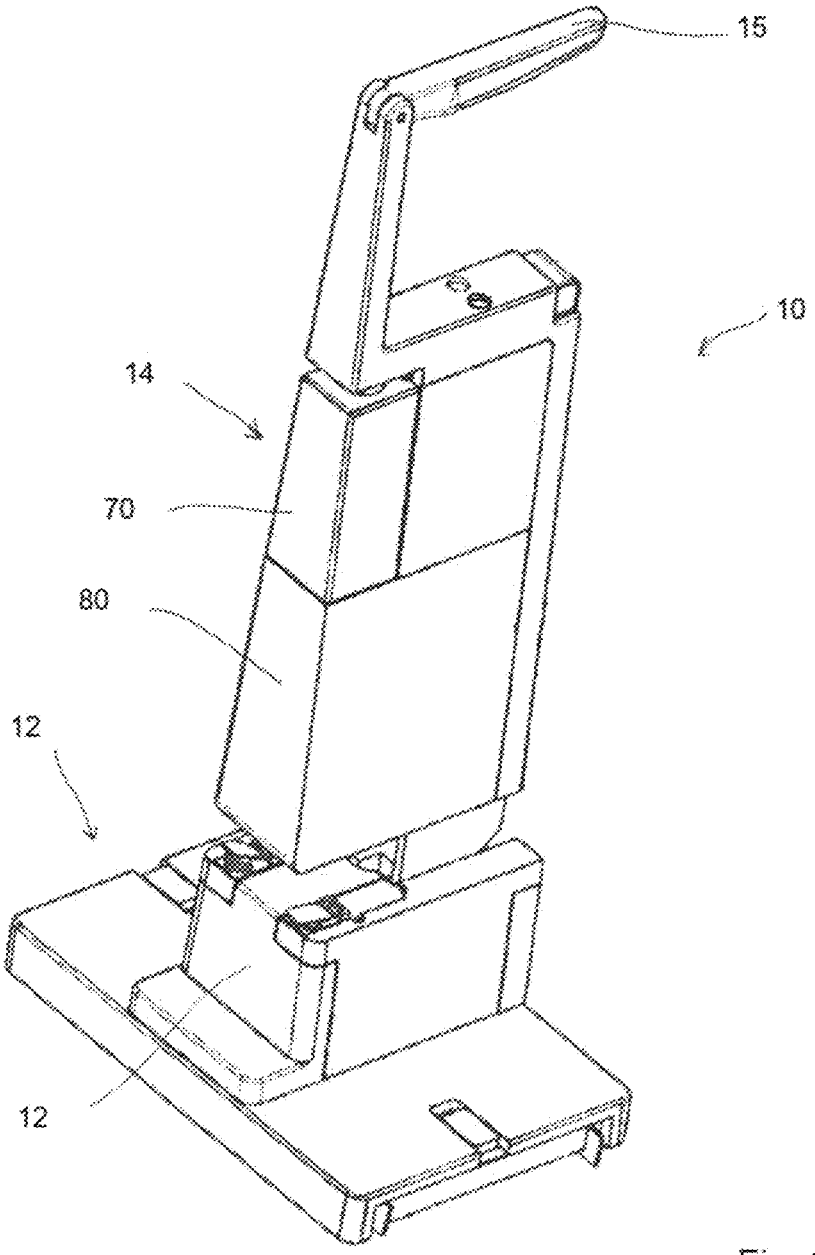
FIG. 1 schematically an external view of the cleaning device.

The cleaning device will be described hereinafter as if it were in the operating position when cleaning a flat and horizontal surface to be cleaned.

Referring to FIGS. 1 to 5, the cleaning device 10 comprises a cleaning head 12 and a handle 14 with an actuating handle 15, which is connected to the cleaning head 12 in an articulated manner. The cleaning head 12 is moved by the user on a surface to be cleaned by actuating the handle 14, and the cleaning device 10 according to the invention can be used in both a forward movement and a backward movement.

In the cleaning head 10, a first cleaning roller 16 and a second cleaning roller 18 are arranged rotatably relative to the housing 19 of the cleaning head 12. The first cleaning roller 16 and the second cleaning roller 18 are rotatable about their respective longitudinal axes and comprise cleaning brushes 20 on the circumference.

The cleaning fluid is stored in a storage container 80, for cleaning fluid with the cleaning fluid preferably comprising water with cleaning solution. However, any other cleaning fluid can be used as well. In the present embodiment example, the first cleaning roller 16 and the second cleaning roller 18 are directly wetted with cleaning fluid during operation, with the cleaning fluid being discharged from outlet nozzles 21 directly in the direction of the cleaning brushes 20 of the cleaning rollers 16, 18.

The cleaning rollers 16, 18 are preferably driven by means of an electric motor which draws energy from an energy storage 70 arranged at the handle 14 and which can be activated and deactivated by a user via a suitable actuating member on or near the actuating handle 15. During operation of the cleaning device 10, the first cleaning roller 16 and the second cleaning roller 18 are set into rotation and wetted with cleaning fluid via the outlet nozzles, so that the surface to be cleaned is scrubbed by means of the cleaning brushes 20 of the cleaning rollers 16, 18. It is also possible, depending on the direction of travel, to drive only the rear cleaning roller when viewed in the direction of movement. As will be explained later, the direction of travel can be determined by the relative position of the handle 14 to the cleaning head 12. Likewise, it is possible not to apply the cleaning fluid directly onto the cleaning rollers 16, 18, but to discharge it in the area between the first cleaning roller 16 and the second cleaning roller 18 in the direction of the surface to be cleaned.

The cleaning rollers 16, 18 are arranged such that their rotational axes are arranged perpendicular to the direction of movement of the cleaning device 10 on the surface to be cleaned.

The cleaning device 10 according to the invention further comprises suction lips, with a first suction lip 22 being arranged parallel to the longitudinal axis of the first cleaning roller 16 and the first end 26 of the cleaning head 10 extending adjacently and substantially parallel to the first cleaning roller 16. The second suction lip 24 is arranged parallel to the longitudinal axis of the second cleaning roller 18 between the second cleaning roller 18 and the second end 28 of the cleaning head 12 extending adjacently and substantially parallel to the second cleaning roller 18.

Both the first suction lip 22 and the second suction lip 24 are each spring-loaded downwards, in the direction of the surface to be cleaned, by means of a suitable elastic element.

A suction gutter is connected to each of the two suction lips. The first suction gutter 30, which opens into a suction line 34 that is in flow connection with a first chamber 38 in a switching device 42, is connected to the first suction lip 22. The second suction gutter 32, which opens into a second suction line 36 that is in flow connection with the second chamber 40 in the switching device 42, is connected to the second suction lip 24.

The switching device 42 serves to guide the negative pressure generated by an electrically driven suction pump 44 only into the suction gutter 30, 32 located at the rear in the direction of movement. This measure serves to be able to keep the suction pump 44 and its energy consumption low by supplying in each case only one of the two suction gutters 30 or 32 with sufficient negative pressure in order to suction off the dirty cleaning fluid collected at the corresponding suction lip 22 or 24.

A switching flap 46 is rotatably mounted in the switching device 42, which supplies either the first chamber 38 connected to the first suction gutter 30 or the second chamber 40 connected to the second suction gutter 32 with negative pressure, depending on the position in the internal volume of the switching device 42. Thus, the negative pressure generated in the suction pump 44 is built up in only one of the two suction gutters 30 or 32 via the suction pipe 48 and the switching device 42.

The suction lips 22, 24 and the switching flap 46 in the switching device 42 are actuated via the position of the handle 14 relative to the cleaning head 12. For this purpose, when moving the cleaning device by pushing it and pulling it back, the handle 14, which is pivotably mounted relative to the cleaning head, is actuated by the user in the conventional manner.

Figure 3:
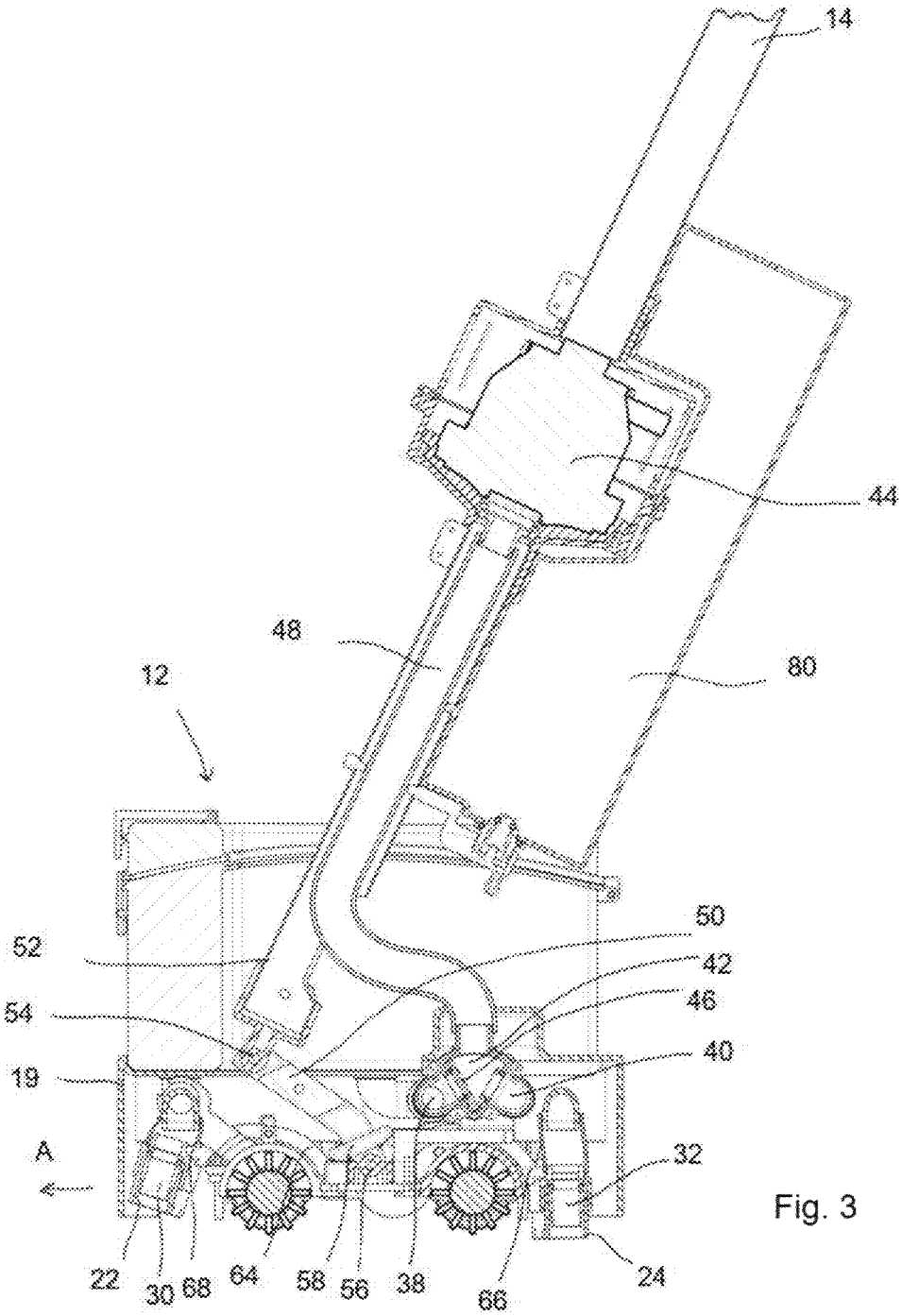
FIG. 3 a sectional view of the device according to FIG. 1, in which the cleaning device is moved in the direction of travel A.

FIG. 3 shows the position of the handle 14 relative to the cleaning head 12 when pushing the cleaning device 10, which is moved in the direction of the arrow A.

As can be seen from FIG. 3, the first suction lip 22 located at the front in the direction of movement A is raised and thus has no contact with the floor of the surface to be cleaned, while the second suction lip 24 arranged at the rear in the direction of movement is lowered downwards and lies on the surface to be cleaned, sweeps over the surface to be cleaned when moving in the direction of the arrow A, and collects cleaning fluid which can be suctioned off at the same time by the second suction gutter 32 arranged in front of the second suction lip 24 in the direction of movement.

Figure 4:
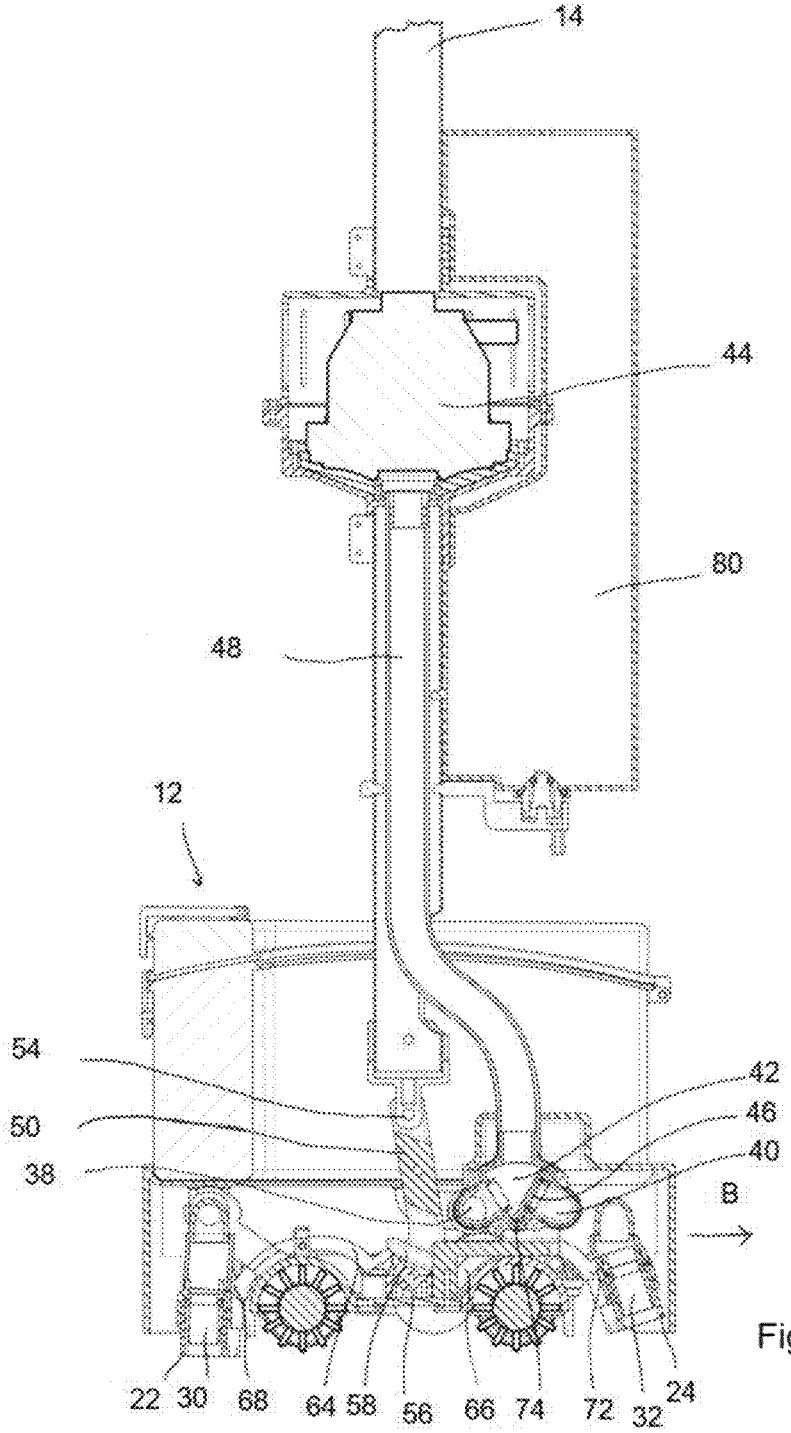
FIG. 4 a sectional view of the device according to FIG. 1, in which the cleaning device is moved in the direction of travel B.
Figure 5:
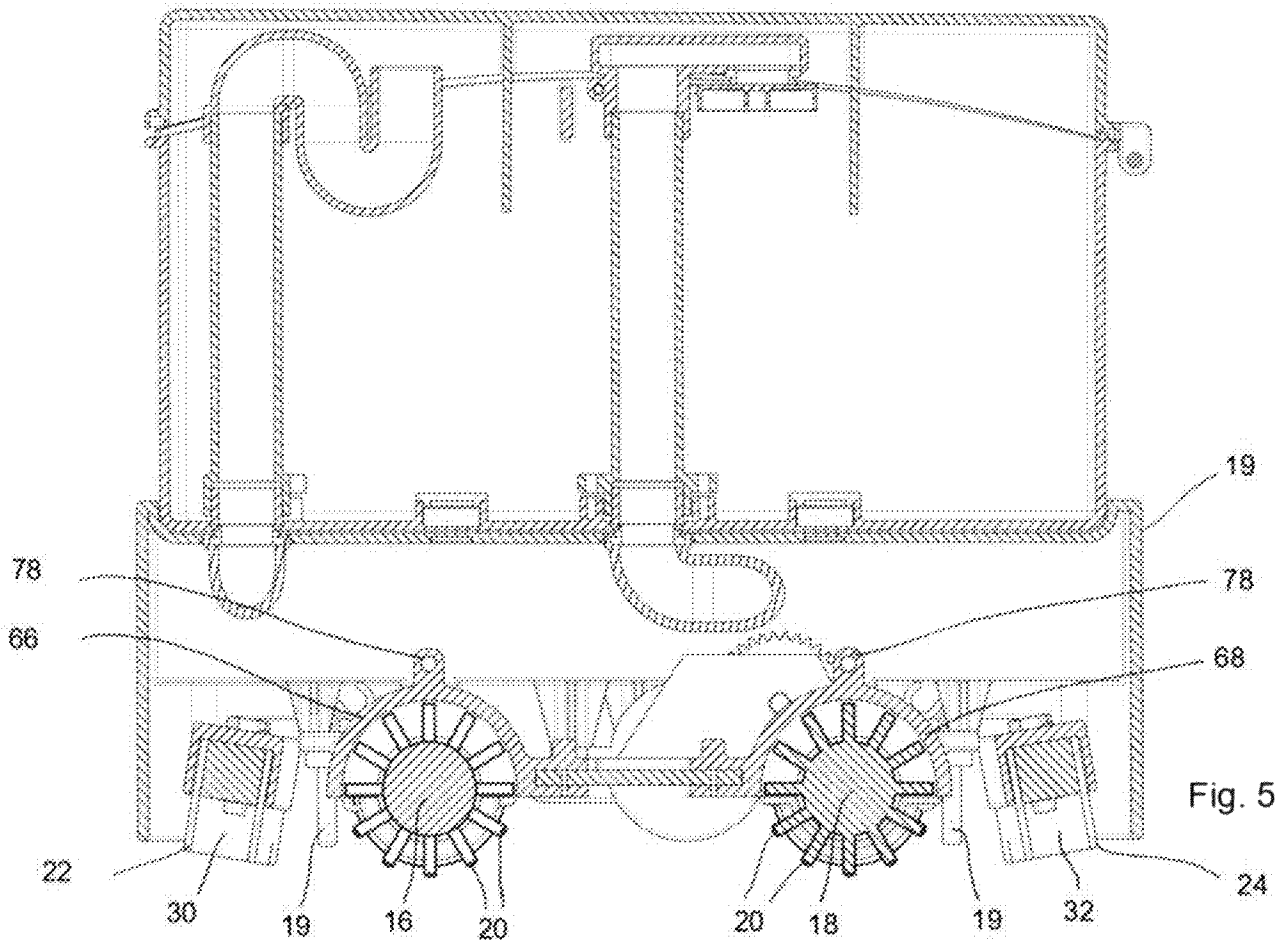
FIG. 5 a further sectional view through the cleaning head of the cleaning device according to the invention corresponding to the actuating position according to FIG. 2.

FIG. 4 shows the backward movement of the cleaning device, which is moved in the direction of the arrow B. As can be seen from the comparison of FIGS. 3 and 4, the handle 14 is in a different position relative to the cleaning head 12.

In the forward direction A according to FIG. 3, the lower end 52 of the handle is at the front in the direction of travel. The lower end 52 of the handle 14 is rotatably connected to a switching lever 50 via a rotational joint 54, one end of which is connected to the lower end 52 of the handle 14 via the rotational joint 54, and the opposite end of which is connected in a torsionally rigid manner to the housing 19 of the cleaning head 12 via a second rotational joint 56.

Near the second rotational joint 56, an actuating member 58 is fixedly connected to the switching lever or integrally configured therewith, which actuates a first suction lip lever 64 or a second suction lip lever 66, depending on the position of the switching lever 50. During the forward movement as shown in FIG. 3, the actuating member 58 presses on the first suction lip lever 64 such that the lever raises the first suction lip 22 together with the first suction gutter 30 by means of a first actuating nose 68, so that the first suction lip has no contact with the surface to be cleaned and is in a non-operational position. The second suction lip 24 arranged at the rear in the direction of travel, however, is not actuated via the actuating member 58 and remains in contact with the surface to be cleaned in a spring-loaded manner.

During the backward movement in the direction of the arrow B, as shown in FIG. 4, the handle 14 is almost perpendicular relative to the cleaning head. Accordingly, in contrast to the position according to FIG. 3, the switching lever 50 is also in a substantially vertical position with respect to the relative position of the first rotational joint 54 and of the second rotational joint 56 to each other. In this position, the actuating member 58 no longer presses on the first suction lip lever 64, so that the first actuating nose 68 no longer raises the first suction lip 22. The suction lip 22 is therefore lowered in the direction of the surface to be cleaned and in contact therewith in a spring-loaded manner. In turn, the actuating member 58 now presses on the second suction lip lever 66 in the same manner as described for forward travel with respect to the first suction lip lever 64. By actuation of the second suction lip lever 66, the second actuating nose 72 is raised upwards, thereby raising the second suction lip 24 upwards into a raised, non-operational position.

It is also clear from the comparison of FIG. 3 during forward travel and FIG. 4 during backward travel that the switching flap 46 in the inner hollow space of the switching device 42 is in opposite positions in each case. During forward travel according to FIG. 3, there is only a flow connection between the first chamber 40 and the suction pipe 48, while the first chamber 38 is closed by the switching flap and therefore the suction pressure generated by the suction pump 44 acts, through the suction pipe 48, only on the second chamber 40 and the second suction gutter 32 which is in flow connection therewith. During forward travel according to FIG. 3, the second suction gutter 32 is in the lowered operating position in the direction of travel at the rear of the cleaning head 12 and suctions off the fluid wiped off the floor by the second suction lip 24. This suctioned-off fluid represents the dirty water to be disposed of, which is suctioned off by the suction pump 44 and collected in the storage container for waste water 60.

During forward travel according to FIG. 3, the first suction gutter 30 is in the raised, non-operational position and is also not subjected to negative pressure since the switching flap 46 closes the first chamber 38 in the switching device 42. Thus, during forward travel according to FIG. 3, the dirty water is suctioned off only at the rear end of the cleaning head 12.

During backward travel according to FIG. 4, the switching flap 46 closes the second chamber 40, so that the second suction gutter 32 which is in flow connection with the second chamber 40 is not subjected to negative pressure. As shown in FIG. 4, the second suction lip 24 and the second suction gutter 32 connected thereto are in the raised, non-operational position during backward travel. In contrast to forward travel, there is, during backward travel, a flow connection between the suction pipe 48 and the first chamber 38 which in turn is in flow connection with the first suction gutter 30 behind the first suction lip 22. During backward travel, the first suction lip 22 and the first suction gutter 30 are lowered in the direction of the surface to be cleaned. The first suction lip 22 sweeps over the surface to be cleaned and wipes off the fluid which is conveyed through the first suction gutter 30, the flow connection into the first chamber 38 of the switching device 42, and subsequently through the suction pipe 48 to the suction pump 44 and collected in the storage container 60 for waste water.

Both the first suction lip lever 64 and the second suction lip lever 66 are rotatably mounted relative to the housing of the cleaning head, which in the specific embodiment example can be realized by a rotatable fixation relative to the housing by means of fixing eyes 78.

Figure 6:
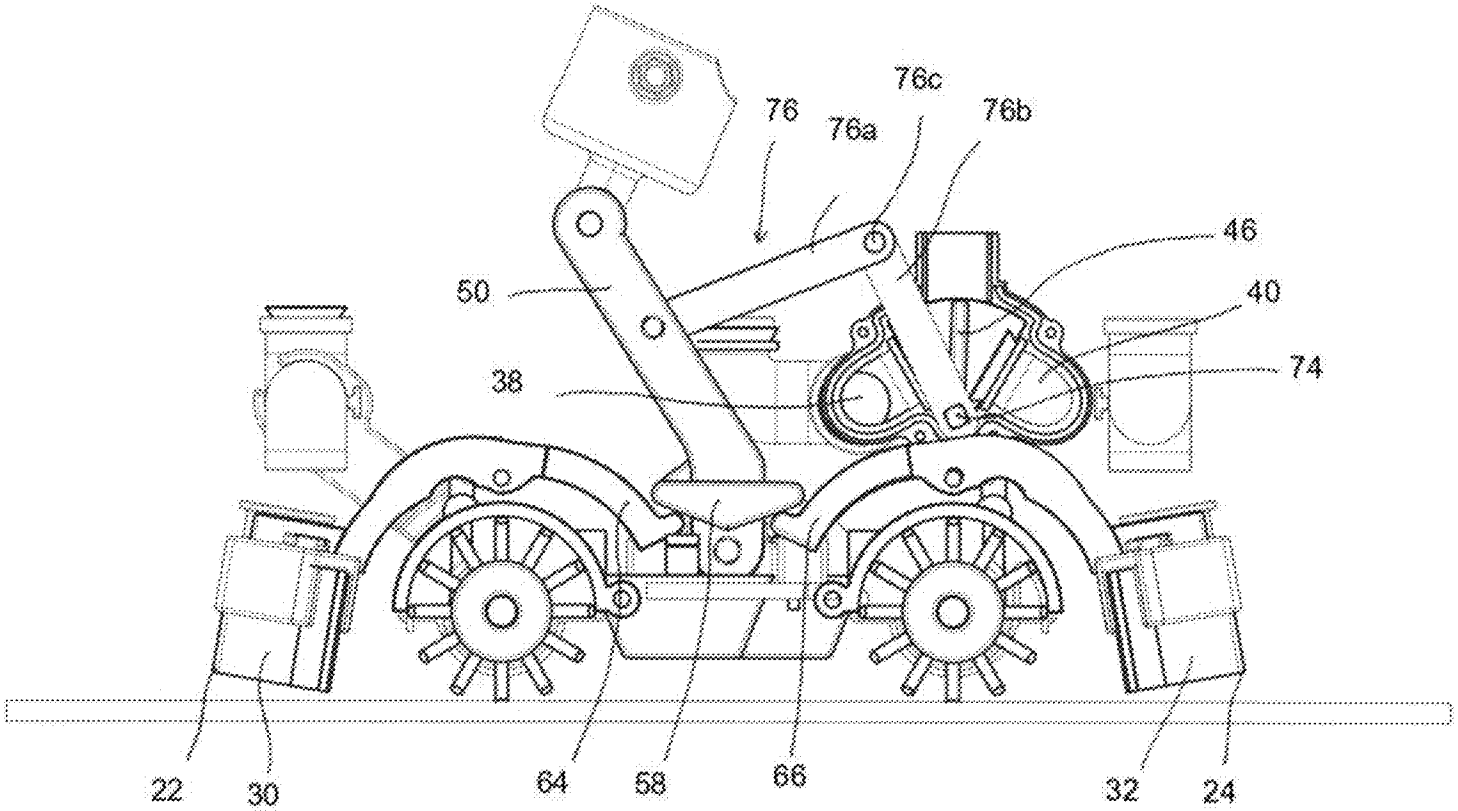
FIG. 6 the actuation of a switching flap in the operation positions corresponding to FIG. 5.
Figure 7:
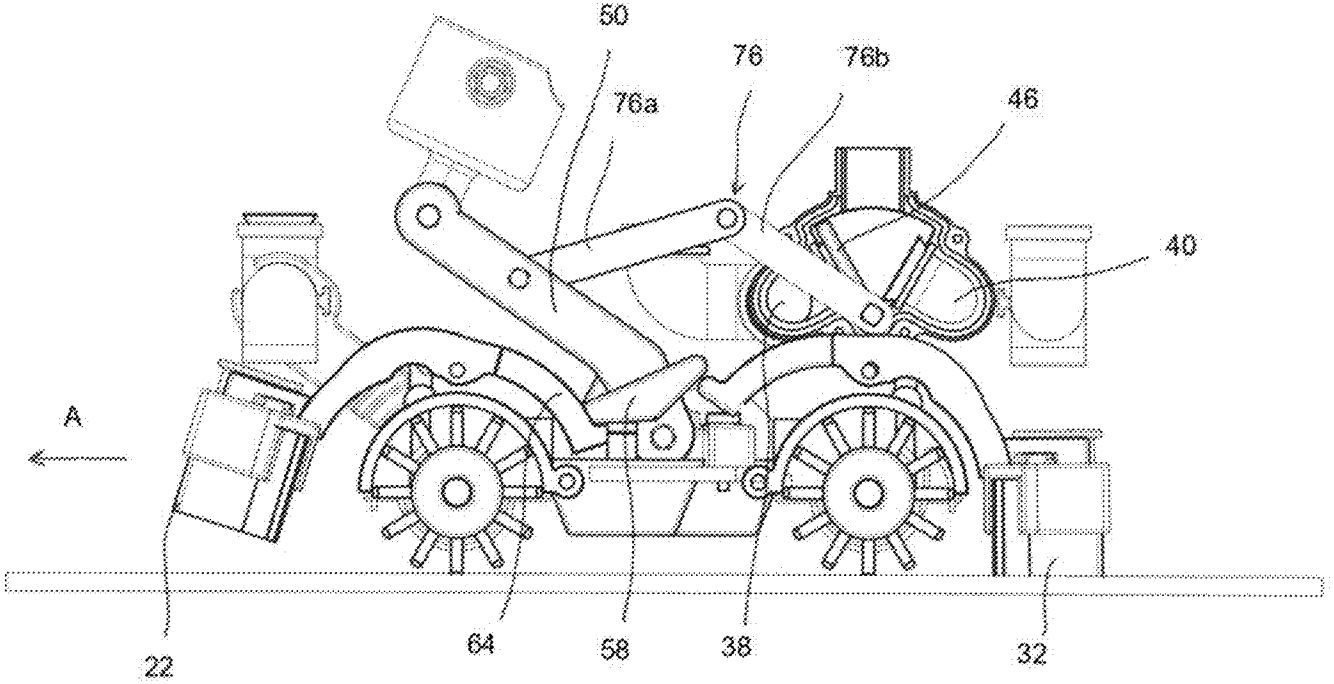
FIG. 7 the actuation of a switching flap in the operation positions corresponding to FIG. 3; and, FIG. 8 the actuation of a switching flap in the operation positions corresponding to FIG. 4.
Figure 8:
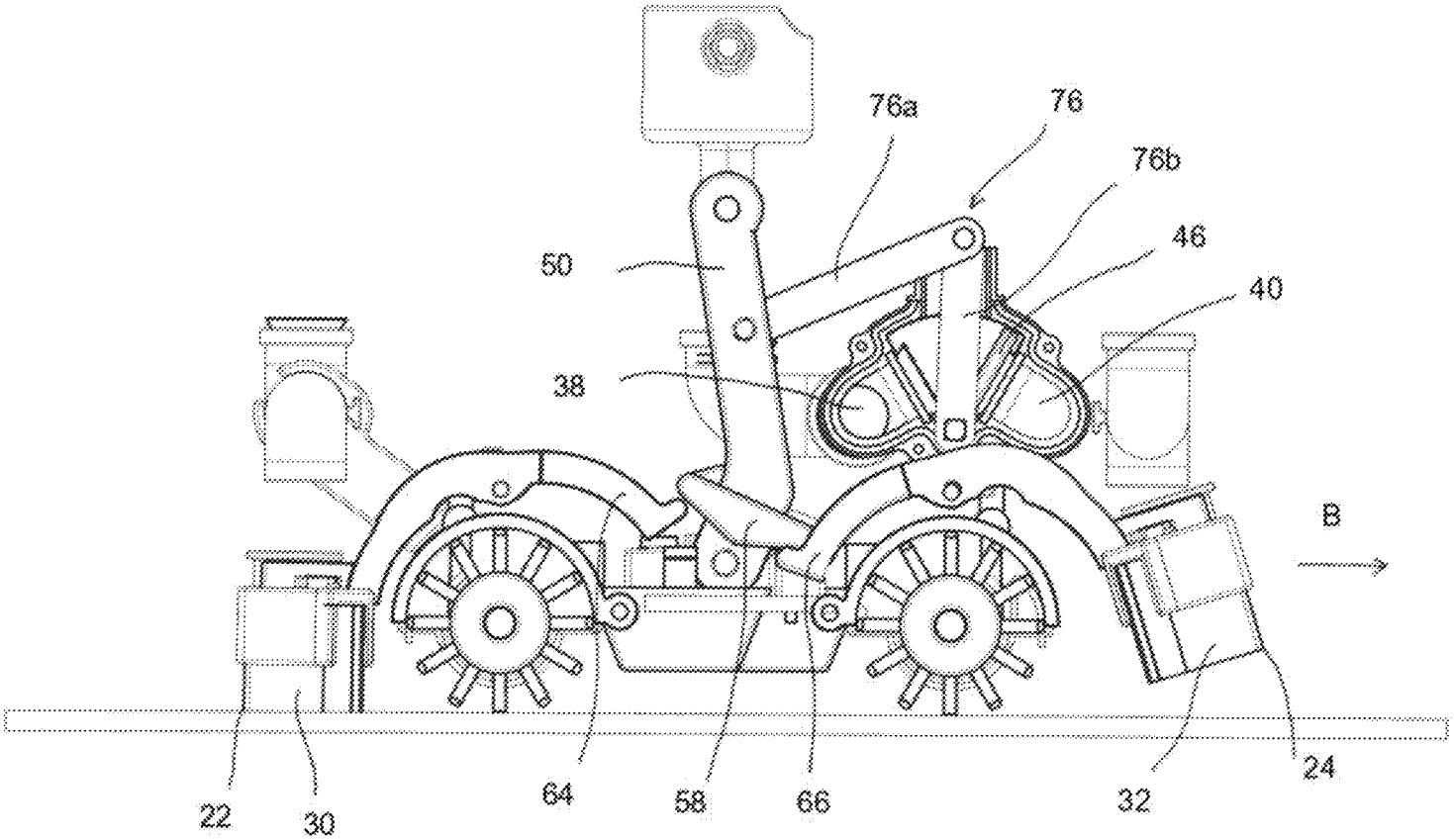

The actuation of the switching flap 46 is preferably also automatically coupled to the selected direction of travel of the cleaning device. For this purpose, the shaft 74 of the switching flap 46, which is rotatably mounted in the switching device 42, is connected in a torsionally rigid manner to an articulated lever 76 which is connected to the handle 14 in an articulated manner and actuates the switching flap when the handle is pivoted. Thus, if the direction of travel of the cleaning device is changed by the position of the handle, the position of the articulated lever 76 also changes accordingly, as shown in the sequence of FIGS. 6 to 8. In this respect, the illustration according to FIG. 6 corresponds to the position of the handle according to FIG. 5, the illustration according to FIG. 7 corresponds to the position of the handle according to FIG. 3, and FIG. 8 corresponds to the position of the handle according to FIG. 4.

FIGS. 6 to 8 show the function of the articulated lever 76 composed of a first portion 76*a* and a second portion 76*b*, which are connected to each other in an articulated manner via a rotational joint 76*c*. The second portion 76*b* of the articulated lever 76 is connected in a torsionally rigid manner to the shaft 74 of the switching flap 46, which is arranged in the intermediate position shown in FIG. 6 such that none of the chambers 38, 40 is closed. If the handle is now brought into the position shown in FIG. 7, in which the cleaning device is moved in the direction of the arrow A, then, on the one hand, the first suction lip lever 64 is actuated via the actuating member 58, as described above, whereby the first suction lip 22 is raised, but at the same time, via actuation of the articulated lever 76, the switching flap 46 is brought into the position in which the first chamber 38 is not subjected to negative pressure, but only the second chamber 40, so that only the second suction gutter 32 is subjected to negative pressure.

In the operating position according to FIG. 8, the handle is in a position in which the cleaning device is moved in the direction of travel B. Accordingly, the switching lever 50 is in a different position already shown in FIG. 4. The actuating member 58 rigidly connected to the switching lever 50 is no longer in engagement with the first suction lip lever 64, but with the second suction lip lever 66, whereby the second suction lip 24 is raised. The first suction lip 22 is now on the surface to be cleaned. By pivoting the switching lever 50, the articulated lever 76 is also pivoted, so that the switching flap 46 is now in a position in which it closes the second chamber 40, so that the negative pressure generated is guided only into the first chamber 38 and acts via the flow connection in the first suction gutter, while there is no negative pressure in the second suction gutter 32.

Figure 2:
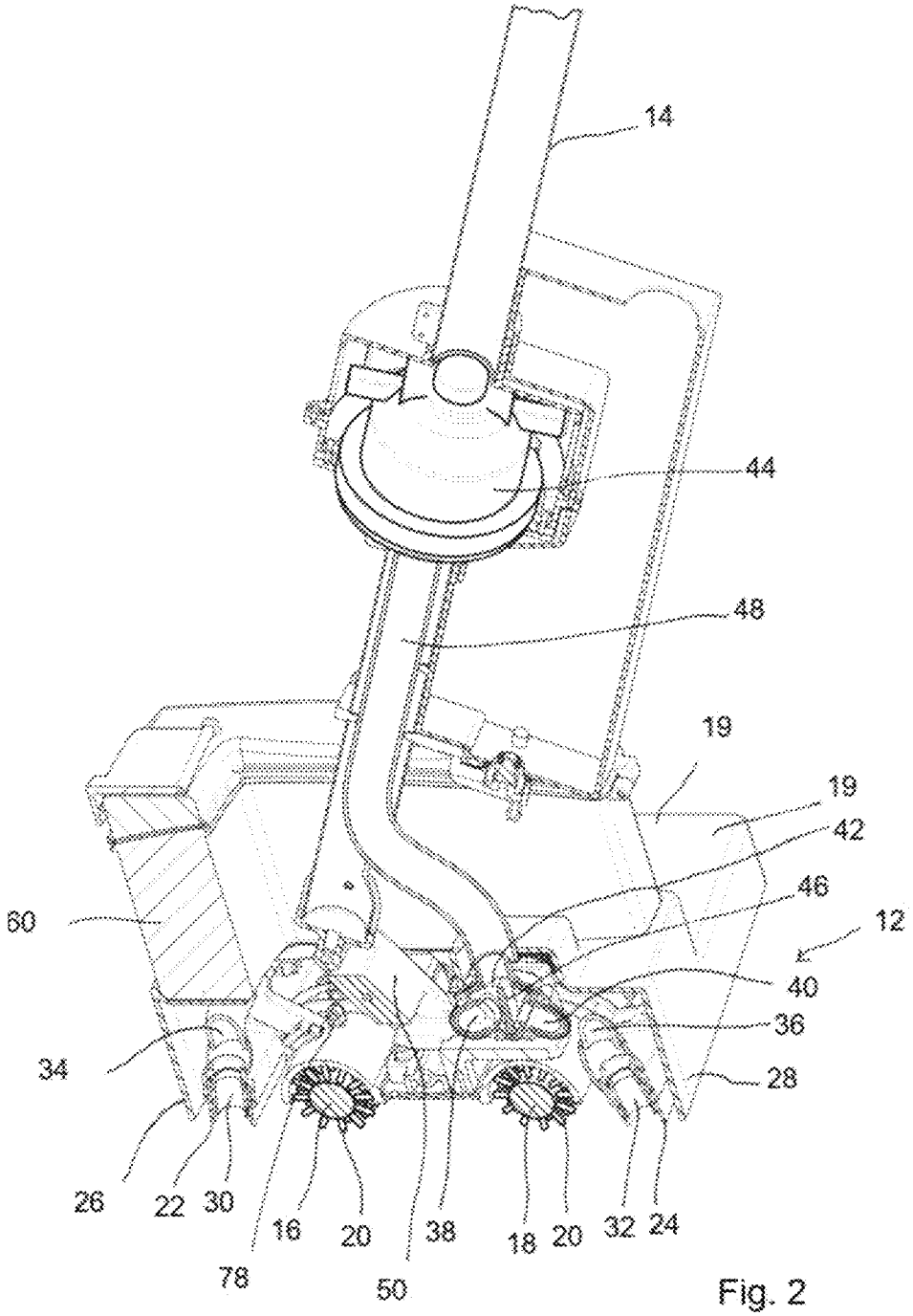
FIG. 2 a three-dimensional sectional view of the cleaning device, with the handle being between the first position and the second position during the movement process.

Alternatively to the solution described, it is also possible, however, to configure the switching flap 46 such that it can be actuated by the user, so that the user can select whether only the suction gutter located at the rear in the direction of travel is subjected to negative pressure, or both suction gutters, which would be the case if the switching flap 46 located in the switching device is in a central position, as shown in FIG. 2, in which both the first chamber 38 and the second chamber 40 are subjected to negative pressure. For this purpose, a suitable actuating member could be provided near the hand lever 15, for example in the form of a tilting lever, by means of which the user can select between the positions forward, backward and suctioning off through both suction gutters. In this case, the actuation of the switching flap 46 could be motor-controlled.

Thus, depending on the direction of travel, the cleaning device according to the invention in each case suctions off the fluid only at the rear end of the cleaning head 12 when viewed in the direction of travel. The cleaning fluid is preferably applied directly onto the cleaning roller arranged at the rear in the direction of travel. The cleaning roller removes the dirt on the surface to be cleaned, which is dissolved in the cleaning fluid and subsequently suctioned off through the suction gutter located at the rear in the direction of travel after it has been wiped off the surface to be cleaned by the suction lip arranged on the corresponding suction gutter. The operating direction is changed by actuating the handle 14 and the switching lever connected thereto. The associated switching of subjecting the suction gutter arranged at the rear in the direction of travel to negative pressure takes place via the switching device and the switching flap movable therein.

By subjecting only one of the two suction gutters to negative pressure, the power of the suction pump can be reduced and/or the service life can be prolonged with a battery charge since low suction power is to be provided for effective cleaning.

The invention claimed is:

1. Cleaning device, comprising: a handle (14); and — a cleaning head (12) which is movable on a surface to be cleaned, wherein — said cleaning head (12) comprises at least one rotatable cleaning roller (16, 18) and a first lip element (22) arranged adjacent to a first suction gutter (30) which can be subjected to negative pressure by means of a suction pump (44); and — said cleaning head (12) comprises a second lip element (24) arranged adjacent to a second suction gutter (32) which can be subjected to negative pressure by means of the suction pump (44); the first lip element (22) and the second lip element (24) are each movable between a raised position and a lowered position; and — the handle (14) is pivotable such that in a first position of said handle (14) relative to the cleaning head (12), the first lip element (22) is in the lowered position and the second lip element (24) is in the raised position, and in a second position of said handle (14) relative to the cleaning head (12), the first lip element (22) is in the raised position and the second lip element (24) is in the lowered position; wherein—the first suction gutter (30) is connected to a first suction channel (34), and the second suction gutter (32) is connected to a second suction channel (36), said first suction channel (34) and said second suction channel (36) opening into a switching device (42) which is connected to the suction pump (44) and which comprises an actuating member (46) configured to close a flow connection to the first suction channel (34) or the second suction channel (36); the handle (14) is in operative connection with the actuating member (46), and said actuating member (46) is movable by pivoting the handle (14) between the first position and the second position; and — the operative connection comprises an articulated lever (76) which translates pivoting of the handle (14) into a rotational movement of the actuating member (46).

2. The cleaning device according to claim 1, further comprising a first lever element (64) which is pivotably mounted relative to the cleaning head (12) and which is suited to move the first lip element (22) from the lowered position into the raised position, and a second lever element (66) which is pivotably mounted relative to the cleaning head (12) and which is suited to move the second lip element (24) from the lowered position into the raised position.

3. The cleaning device according to claim 2, characterized in that the handle (14) is fixed to the cleaning head (12) by means of a switching lever (50), and in the first position of said handle (14), the switching lever (50) is in engagement with the second lever element (66), and in the second position of said handle (14), the switching lever (50) is in engagement with the first lever element (64).

4. The cleaning device according to claim 1, characterized in that in the first position of the handle (14), the actuating member (46) closes the flow connection to the second suction channel (36), and in the second position of the handle (14), the actuating member closes the flow connection to the first suction channel (34).

5. The cleaning device according to claim 1, characterized in that the first lip element (22) together with the first suction gutter (30) forms a unit, and the second lip element (24) together with the second suction gutter (32) forms a second unit.

6. The cleaning device according to claim 1, wherein the at least one rotatable cleaning roller comprises two cleaning rollers (16, 18) that are arranged parallel to each other between the first suction gutter (30) and the second suction gutter (32).

7. The cleaning device according to claim 6, characterized in that each of said two cleaning rollers (16, 18) comprises cleaning brushes (20).

8. The cleaning device according to claim 1, further comprising a storage container (60) for cleaning fluid and nozzles (21) for discharging said cleaning fluid in the direction of the surface to be cleaned and/or in the direction of the at least one cleaning roller (16, 18).

9. The cleaning device according to claim 1, further comprising an energy storage (70) for operating the cleaning device (10), wherein the suction pump (44) and at least one electric motor can be driven by means of energy from said energy storage (70) for driving the at least one cleaning roller (16, 18).

10. Cleaning device, comprising: a handle (14); and — a cleaning head (12) which is movable on a surface to be cleaned, wherein — said cleaning head (12) comprises at least one rotatable cleaning roller (16, 18) and a first lip element (22) arranged adjacent to a first suction gutter (30) which can be subjected to negative pressure by means of a suction pump (44); and — said cleaning head (12) comprises a second lip element (24) arranged adjacent to a second suction gutter (32) which can be subjected to negative pressure by means of the suction pump (44); the first lip element (22) and the second lip element (24) are each movable between a raised position and a lowered position; and — the handle (14) is pivotable such that in a first position of said handle (14) relative to the cleaning head (12), the first lip element (22) is in the lowered position and the second lip element (24) is in the raised position, and in a second position of said handle (14) relative to the cleaning head (12), the first lip element (22) is in the raised position and the second lip element (24) is in the lowered position; the cleaning device further comprising a first lever element (64) which is pivotably mounted relative to the cleaning head (12) and which is suited to move the first lip element (22) from the lowered position into the raised position, and a second lever element (66) which is pivotably mounted relative to the cleaning head (12) and which is suited to move the second lip element (24) from the lowered position into the raised position; wherein — the handle (14) is fixed to the cleaning head (12) by means of a switching lever (50), and in the first position of said handle (14), the switching lever (50) is in engagement with the second lever element (66), and in the second position of said handle (14), the switching lever (50) is in engagement with the first lever element (64).

11. The cleaning device according to claim 10, characterized in that the first suction gutter (30) is connected to a first suction channel (34), and the second suction gutter (32) is connected to a second suction channel (36), said first suction channel (34) and said second suction channel (36) opening into a switching device (42) which is connected to the suction pump (44) and which comprises an actuating member (46) configured to close a flow connection to the first suction channel (34) or the second suction channel (36).

12. The cleaning device according to claim 11, characterized in that in the first position of the handle (14), the actuating member (46) closes the flow connection to the second suction channel (36), and in the second position of the handle (14), the actuating member closes the flow connection to the first suction channel (34).

13. The cleaning device according to claim 10, characterized in that the first lip element (22) together with the first suction gutter (30) forms a unit, and the second lip element (24) together with the second suction gutter (32) forms a second unit.

14. The cleaning device according to claim 10, characterized in that the handle (14) is in operative connection with an actuating member (46), and said actuating member (46) is movable by pivoting the handle (14) between the first position and the second position.

15. The cleaning device according to claim 14, characterized in that the operative connection comprises an articulated lever (76) which translates pivoting of the handle (14) into a rotational movement of the actuating member (46).

16. The cleaning device according to claim 10, wherein the at least one rotatable cleaning roller comprises two cleaning rollers (16, 18) that are arranged parallel to each other between the first suction gutter (30) and the second suction gutter (32).

17. The cleaning device according to claim 16, characterized in that each of said two cleaning rollers (16, 18) comprises cleaning brushes (20).

18. The cleaning device according to claim 10, further comprising a storage container (60) for cleaning fluid and nozzles (21) for discharging said cleaning fluid in the direction of the surface to be cleaned and/or in the direction of the at least one cleaning roller (16, 18).

19. The cleaning device according to claim 10, further comprising an energy storage (70) for operating the cleaning device (10), wherein the suction pump (44) and at least one electric motor can be driven by means of energy from said energy storage (70) for driving the at least one cleaning roller (16, 18).

* * * * *